United States Patent [19]

Faure

[11] Patent Number: 4,492,075

[45] Date of Patent: Jan. 8, 1985

[54] METHOD FOR PRODUCING FIBER SPUN YARNS AND THE FIBER SPUN YARNS OBTAINED WITH SAID METHOD

[75] Inventor: Jean-Louis Faure, Roanne, France

[73] Assignee: ASA S.A., Villeurbanne, France

[21] Appl. No.: 458,701

[22] Filed: Jan. 17, 1983

[30] Foreign Application Priority Data

Jan. 26, 1982 [FR] France ..... 82 01381

[51] Int. Cl.[3] ..... D02G 3/34; D02G 3/38

[52] U.S. Cl. ..... 57/5; 57/224

[58] Field of Search ..... 57/3, 5, 6, 210, 224, 57/225–228, 315, 328, 329, 331, 908

[56] References Cited

U.S. PATENT DOCUMENTS 4,056,924 11/1977 Umiastowski ..... 57/5
4,209,965 7/1980 Bobkowicz ..... 57/5
4,287,714 9/1981 Takai ..... 57/336
4,359,856 11/1982 Bobkowicz ..... 57/6 X
4,364,223 12/1982 Vignon ..... 57/5

*Primary Examiner*—Donald Watkins
*Attorney, Agent, or Firm*—Parkhurst & Oliff

[57] ABSTRACT

Method for producing a fiber spun yarn of the type in which parallelized elementary fibers are joined to a textile core, subjected to a false twist, said fibers being projected on the core, upstream of the false twist spindle.

According to the invention, in the fibers projection zone, the core is guided into a channel with an open face which is situated in facing relation to the elementary fibers projection zone and the surface of which is subjected to a flow of fluid tending to exert a pulling force on the end of the fibers.

8 Claims, 3 Drawing Figures

Figure 1:
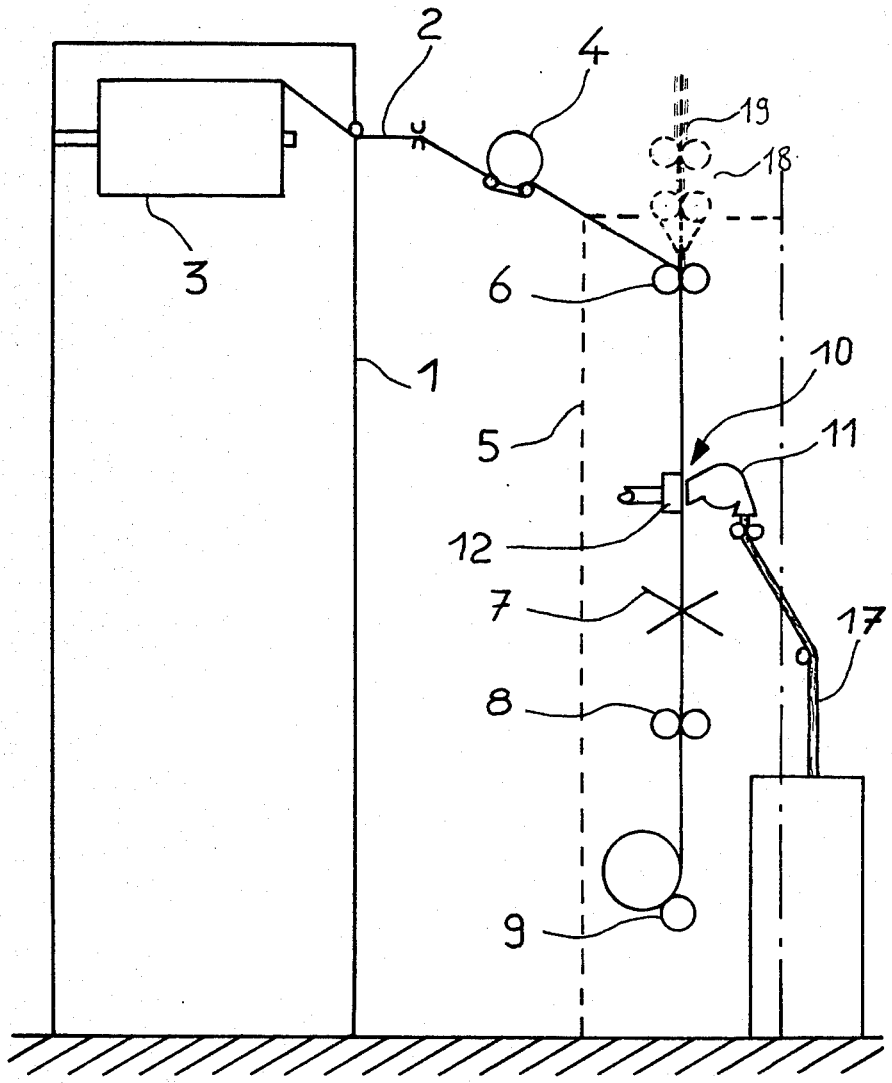

METHOD FOR PRODUCING FIBER SPUN YARNS AND THE FIBER SPUN YARNS OBTAINED WITH SAID METHOD

The present invention relates to an improved method, and to a device for carrying out the method. The method enables the simple, low cost and high speed production of a new type of spun yarn from fibers with a unidirectional twist throughout its length without using ring and traveler winding systems.

For a long time now the aim has been to increase the speed of production of fiber spun yarns while retaining all the properties and characteristics of such yarns.

Various solutions have been proposed to replace the conventional spinning techniques wherein the cores of fibers are subjected to successive doublings and draftings.

Among these techniques is open end spinning. This method, which is well known to the technicians, is however difficult to perform and requires different types of equipment depending on the nature and/or on how big and long the fibers are.

It has also been proposed to produce yarns having the appearance of spun fiber yarns by projecting discontinuous fibers over a multifilament core coated with an adhesive material.

Further, it has been proposed to incorporate discontinuous fibers with a multifilament core, using for example a false twist system, so that upstream of the false twist member, the filaments are separated and open, the fibers being incorporated at that level and the yarn resuming its initial twist, thus holding back the fibers coming off the false twist spindle. It has also been proposed to cause the separation of the elementary yarns of such a core by way of electrostatic charges.

It should however be noted that aside from open end spinning, no solution proposed to this day has found any real industrial application.

The object of the present invention is an improved method that considerably increases production speed over conventional spinning techniques and also leads to a spun yarn showing good textile quality, with a unidirectional twist throughout its length.

The method according to the invention is also very versatile in that it can just as well be used to obtain regular yarns as to obtain fancy type yarns with for example flame, knots or nub effects.

The invention also relates to a device for carrying out the method, as well as to the new type of yarns obtained according to the method.

In general, the method according to the invention is of the type wherein parallelized elementary fibers are joined to a textile core, subjected to a false twist, the fibers being projected on the core upstream of the false twist spindle, which method is characterized by the fact that in the fiber projection zone, the core is guided into a channel with an open face which is situated in facing relation to the elementary fiber projection zone and the surface of which is subjected to a flow of fluid tending to exert a pulling force on the end of the fibers.

It has been noted that such a method enables the obtainment of a spun yarn in which the fibers are firmly entrapped, held in position and distributed around the core while retaining a real twist around the core, which core, on the contrary, is virtually twist-free.

Although the method according to the invention enables the obtainment of perfectly regular yarns, it is easily adaptable to obtain fancy yarns, by varying for example the feed speed of the yarn and/or the length of the twist run back upstream of the spindle and/or the quantity of fibers projected on the core.

Moreover, although the core is advantageously constituted by a multifilament continuous yarn, it can also be constituted by any other filiform textile element, such as for example by a spun fiber yarn to which a multifilament core can be optionally associated.

The following means will be advantageously used to carry out the invention:

a friction spindle as a false twist spindle, such as the type with crossed belts, produced for example according to the teaching of U.S. Pat. No. 4,296,598, a licker-in of known type as means for projecting the parallel elementary fibers on the core yarn, such as the conventional licker-in used in open end spinning or any other equivalent means constituted for example by a conventional stretching system with rollers and belts or by a stretching device of the selector type, a plate of steel as the core yarn guiding channel, for example of V-shaped cross-secion, the bottom of said plate being provided with orifices and being subjected to a depression which causes a flow of fluid exerting a pulling force on the fiber ends.

Other equivalent means such as, for example, an internal friction false twist spindle, and even a compressed air spindle, may of course be used without departing from the scope of the invention. Moreover, if the flow of fluid on the surface of the guiding channel can be obtained by creating a depression on said surface, it should be possible to create such a flow with jets of fluid acting on the open face side of the guiding channel.

Figure 2:
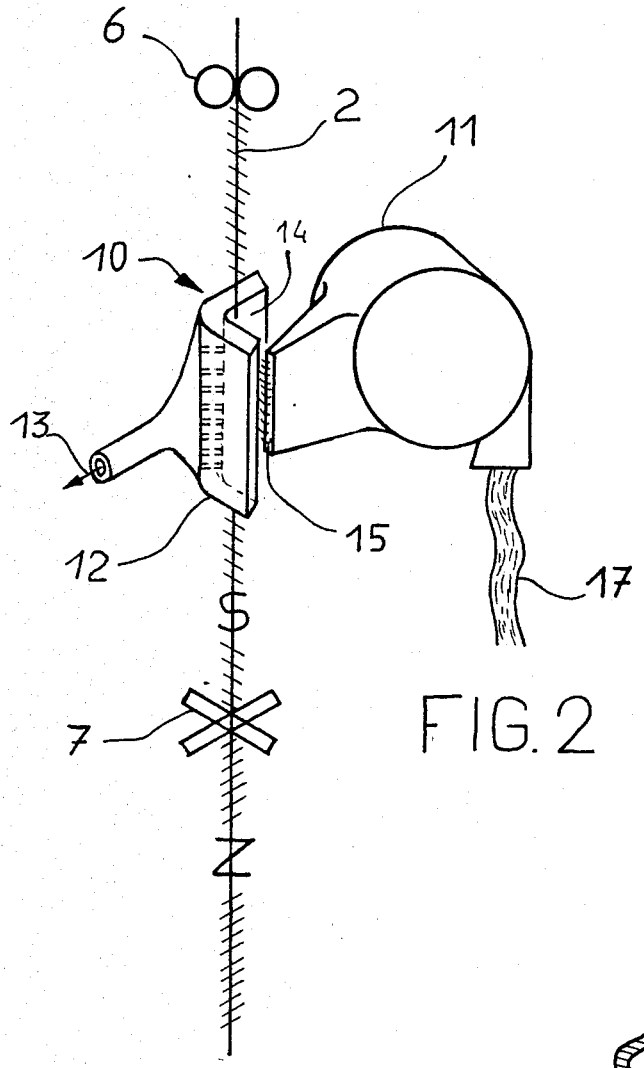
Figure 3:
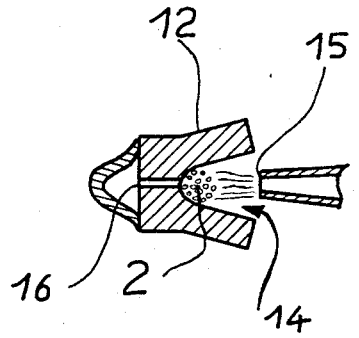

The invention will be more readily understood on reading the following examples with reference to the accompanying drawings, in which:

FIG. 1 diagrammatically illustrates a side view of a working position of a machine used for carrying out the method according to the invention, FIG. 2 is a diagrammatical perspective view showing in more detail an embodiment of the method according to the invention, and FIG. 3 is a plan view of a cross-section of a guiding channel constituted by a suction plate of V-shaped cross-section, defining the zone where the fibers joined to the core.

FIG.1 is a side view of a working position of the machine in which the method permitting the high speed production of a spun yarn with unidirectional twist according to the invention is performed.

The machine comprises in known manner, a storage zone (1) for multifilament yarns (2) supplied by bobbins (3).

An optional intermediate delivery member (4) which is constituted for example by a continuous shaft extending over the entire length of the machine and on which rest the rollers, or belts, enables the yarn (2) to be brought to the yarn-treating members proper, which members are regrouped, for example on a frame (5) situated in facing relation with the storage zone (1).

The yarn-treating members proper are constituted in known manner and, if following the path of the yarn, by:

a delivery member (6) advantageously constituted by a continuous shaft extending over the entire length of the spinning machine and on which member rest pressing rollers for each yarn (2), a false twist spindle (7), preferably constituted by two crossed belts, such as for example of the type described in U.S. Pat. No. 4,296,598, a second delivery member (8) and non-twist winding means (9).

According to the invention, an assembly is provided upstream of the false twist spindle, designated in general as (10) which permits parallelized elementary fibers to be projected onto the core yarn (2).

The assembly (10) consists of:

on the one hand, a conventional licker-in (11) for example of the type used for carrying out the spinning technique known as open end spinning, a rove (17) being introduced in said licker-in (11).

on the other hand, a plate (12) connected to a suction source (13) (not shown) and placed in facing relation to the outlet of the licker-in (11); the plate (12), as clearly seen in FIGS. 2 and 3, is provided with a V-shaped groove, defining a guiding channel whose open part is situated in facing relation to the outlet (15) of the licker-in (11); in order to create a flow of fluid on the surface of the channel, the surface of the plate (12) is grooved (16) through its thickness, the grooves issuing into a joint conduit connected with a source of suction.

As indicated above, the core yarn (2) may be constituted by a continuous multifilament yarn, but other types of core yarns could also be used to perform the invention. As illustrated in dotted lines in FIG. 1, a spun fiber yarn can be used which is produced directly on the machine, a stretching system (18) being for example provided for a rove of fiber (19). In this case the delivery member (6) may be constituted by the last pair of stretching rollers of the said stretching system (18). Obviously, such a fibrous core can also be associated to a continuous yarn by bringing a multifilament yarn (2) upstream of the delivery member (6).

EXAMPLE 1

With an installation of the type illustrated in the accompanying figures, a fiber spun yarn is produced according to the invention in the following conditions:

core yarn: multifilament yarn (2) constituted by a polyester yarn of 72 decitex −33 strands, feed speed of the delivery members (4) and (6): 100 m/min.

false twist spindle (7): spindle with crossed belts forming together an angle of 46° and having a linear speed of 250 m/min.

winding spindle (9): of the type with peripheral drive; drawing speed: 100 m/min.

A rove (17) of 30,000 decitex (Nm=0.3) containing cotton is fed to the licker-in (11). The stretching of the rove (17) in the licker-in is adjusted to 300.

The suction plate (12) placed in facing relation to the outlet (15) of the licker-in (11) is provided with a 5 mm deep V-shaped split and with a 10 mm-wide open part. Said plate (12) is 5 cm long and comprises 15 orifices (16) of 1 mm diameter placed at regular intervals.

The source of depression (13) is adjusted so as to create a suction of around 200 mm water.

The plate (12) is placed upstream of the spindle (7) so that the yarn (2) comes tangentially in contact with the bottom of the V-split.

When working under the aforesaid conditions, a spun yarn is obtained which is constituted by a core of virtually parallel elementary filaments, said core being covered with a layer of fibers with a real twist.

Such a yarn can be used for all the conventional applications, such as weaving and, knitting.

EXAMPLE 2

Example 1 is repeated, except that the multifilament core (2) is introduced into a rove (19) stretched upstream of the cylinders (6) such as illustrated in dotted lines in FIG. 1.

The rove (19) contains wool and measures 3000 decitex (Nm 3), the stretching achieved in (18) being 30 times.

With the aforesaid conditions, the resulting spun yarn has a core which is itself constituted by a spun yarn with a core, said core being virtually twist-free whereas the peripheral fibers coming from the rove (17) are on the contrary twisted and perfectly linked around the said core.

The invention is in no way limited to the description given above and on the contrary covers any variant which can be brought thereto without departing from the scope or the spirit thereof.

For example, the method according to the invention can be applied in combination with any of the known methods for producing fancy yarns by, for example, varying the feeding speed and/or the winding speed.

It could likewise be arranged to wind simultaneously two yarns produced according to the invention on the same support with or without a slight assembling twist, or by causing them to self-wind.

Finally, if in the foregoing embodiment, the fibers are brought on the core by means of a licker-in, it is obvious, as indicated above that any other equivalent system permitting the stretching of a rove of fibers could be used for carrying out the invention, such as for example belt-type or selector-type stretching systems.

What is claimed is:

1. A method for producing a spun fiber yarn upstream of a false twist spindle, comprising:

(a) providing a textile core comprising a single yarn;

(b) guiding said core tangentially into a V-shaped channel having an open face and a bottom, said open face of said channel facing a parallelized elementary fibers projection zone;

(c) providing parallelized elementary fibers in said parallelized elementary fibers projection zone, said parallelized elementary fibers being projected on and joined to said textile core; and (d) subjecting said bottom of said channel to a flow of fluid to exert a pulling force on said parallelized elementary fibers.

2. The method of claim 1, wherein said textile core comprises a continuous multifilament yarn.

3. The method of claim 2, wherein said continuous multifilament yarn core is introduced into a rove of fibers upstream of said parallelized elementary fibers projection zone.

4. The method of claim 1, wherein the bottom of said channel is provided with orifices and is subjected to suction causing a flow of fluid on the surface of said channel.

5. The method of claim 1, further comprising, providing a crossed-belt type false twist spindle and wherein said parallelized elementary fibers are projected by a licker-in.

6. A spun fiber yarn obtained by the method of claim 1, wherein said yarn comprises a single yarn core covered with discontinuous fibers, said discontinuous fibers being firmly entrapped, held in position and distributed around said core while retaining a real twist around the core, said core being virtually twist-free.

7. The spun yarn of claim 6, wherein said core comprises a multifilament continuous yarn.

8. The spun yarn of claim 6, wherein said core comprises a spun fiber yarn having an internal multifilament continuous core.

* * * * *